US005936497A

United States Patent [19]

Vilou

[11] Patent Number: 5,936,497

[45] Date of Patent: Aug. 10, 1999

[54] STARTER CONTACTOR HAVING AN ELECTRONIC CONTROL CIRCUIT, AND A VEHICLE ENGINE STARTER HAVING SUCH A CONTACTOR

[75] Inventor: Gérard Vilou, Tassin, France

[73] Assignee: Valeo Equipements Electriques Moteur, Creteil, France

[21] Appl. No.: 08/965,736

[22] Filed: Nov. 7, 1997

[30] Foreign Application Priority Data

Nov. 7, 1996 [FR] France ..... 96.13721

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 4,117,231 | 9/1978 | Hansen et al. . | |
| 4,644,179 | 2/1987 | Pointout et al. . | |
| 4,990,874 | 2/1991 | Shiroyama | 335/126 |
| 5,703,551 | 12/1997 | Lefebvre et al. | 335/126 |
| 5,757,256 | 5/1998 | Vilou | 335/126 |

FOREIGN PATENT DOCUMENTS 0 155 983 10/1985 European Pat. Off. .

OTHER PUBLICATIONS

French Search Report dated Jul. 25, 1997.

*Primary Examiner*—Lincoln Donovan
*Attorney, Agent, or Firm*—Morgan & Finnegan LLP

[57] ABSTRACT

A motor vehicle starter contactor includes a fixed core and a control rod for displacing a movable contact into and out of cooperation with fixed contact terminals carried on the base of a cover hood of the contactor. The contactor also has an electronic control circuit, the components of which are carried by a printed circuit board in the form of a disc, which is located within the cover hood of the contactor, in an axial position intermediate between the fixed core and the movable contact. The printed circuit board is fixed on a support which is carried by the fixed core. The support provides, in particular, electrical ground connection between the printed circuit and the fixed core.

13 Claims, 4 Drawing Sheets

STARTER CONTACTOR HAVING AN ELECTRONIC CONTROL CIRCUIT, AND A VEHICLE ENGINE STARTER HAVING SUCH A CONTACTOR

FIELD OF THE INVENTION

The present invention relates to contactors for the starters of internal combustion engines for motor vehicles, of the kind having an electronic control circuit.

BACKGROUND OF THE INVENTION

In a known design of such a contactor, the contactor comprises a cylindrical annular armature in which a contactor coil is arranged. The coil actuates a movable core, which is thereby displaced axially so as to act on a control rod, which extends in its center through a fixed core in the form of a disc, which is arranged at a front axial end of the armature. The control rod, in its turn displaces a movable contact into and out of engagement with two fixed contact terminals. These contact terminals are arranged to be connected in the power supply circuit of the starter motor, and are carried in the base portion of a cover hood of the contactor. The cover hood has the general form of a cylindrical pot, so that it includes a lateral skirt portion which defines within it a housing in which the movable contact is contained.

It is also known to equip the contactor with an electronic control circuit for controlling operation of the contactor. Such a circuit typically includes a printed circuit board, with the components of the circuit being carried on the circuit board. It is also known to arrange the electronic control circuit within a hermetically sealed casing, which is then secured on the outside of the starter, on the support pedestal or bracket of the starter, or on the contactor itself, or again on the casing of the electric starter motor. The casing for the electronic control circuit may also be fixed on the bodywork of the vehicle, in the engine compartment.

It is then necessary to provide wires or cables which connect the casing of the control circuit, firstly with the starter contactor, and secondly with the other appropriate components of the vehicle which play a part in the control of the engine starting operation, for example the ignition switch, the anti-theft system, an electronic computer unit for controlling fuel injection, ignition, and so on.

The arrangement of the electronic control circuit in an independent casing, therefore, leads to the need to provide an additional component, that is to say a separate control unit casing, which is relatively bulky and which further makes it necessary to provide additional electrical connections, and to carry out particular assembly operations on the vehicle.

DISCUSSION OF THE INVENTION

An object of the invention is to overcome the above mentioned drawbacks, and in particular to eliminate the need for the above mentioned wires or cables, the provision of a separate casing for the electronic control circuit, and the associated assembly operations.

According to the invention in a first aspect, a contactor for a motor vehicle starter, of the type comprising an annular cylindrical armature in which is arranged a contactor coil which actuates an axially movable core that acts on a control rod which passes through the center of a fixed core in the form of a disc, the contactor being further of the type in which the control rod effects displacements of a movable contact which is adapted to cooperate with two fixed contact terminals forming part of the power supply circuit to the motor of the starter, the said fixed contact terminals being arranged in the base portion of a cover hood, the lateral skirt portion of which defines a housing in which the movable contact is arranged, the contactor being also of the type that includes an electronic control circuit for controlling the contactor, the components of the said circuit being carried by a printed circuit board in the form of a disc, which has a central aperture to allow the body of the control rod to pass through it, the printed circuit board being disposed within the cover hood, in an axial position intermediate between the fixed core and the movable contact, is characterised in that the printed circuit board is fixed on a support which is attached on the fixed core, and in that the support provides the electrical earth connection between the printed circuit and the fixed core.

According to a preferred feature of the invention, the conductive element of the support includes a set of lugs which extend radially outwards substantially in a transverse plane, with each of the said lugs including a pad for contact and fastening of the support, each said pad extending axially rearwards towards the transverse front face of the fixed core, against which the pads are in contact, each said lug being extended axially forward by a branch for fastening the printed circuit board and for connecting the printed circuit electrically to earth.

Preferably, each said contact pad consists of a boss formed in the corresponding said transverse lug which is fixed to the transverse front face of the fixed core, in particular by welding.

According to another preferred feature of the invention, each axial fastening branch terminates in a transverse front edge which defines an axial surface for engagement with a portion, in facing relationship therewith, of the rear face of the printed circuit board, the front edge being extended by an axial terminal tag which is received in an aperture of the printed circuit board, and which projects axially beyond the front face of the latter so as to be joined by soldering to a conductive earthing element of the printed circuit.

Each aperture in the printed circuit board that receives a said terminal tag is preferably a notch formed in the peripheral edge of the printed circuit board.

Preferably, the support has three said transverse lugs, spaced apart circumferentially by 120 degrees.

Preferably also, the support includes a body of insulating material which at least partially surrounds the conductive element, and which includes means for positioning the support with respect to the fixed core.

According to a further preferred feature of the invention, the insulating body of the support is a layer of insulating material superimposed by molding it around the conductive element.

Preferably, the insulating body includes a cylindrical centering surface, which extends axially rearwardly and which is received in a central hole of the fixed core, and further includes an angular indexing finger for indexation of the support with respect to the fixed core.

According to yet another preferred feature of the invention, the support includes at least one electrical connecting pin of conductive material, the body of which extends axially forward through an aperture in the printed circuit board, so as to be connected electrically by soldering to a conductive area of the printed circuit, the body of each said connecting pin being extended axially beyond the front face of the printed circuit board and through the transverse base portion of the cover hood to be connected electrically by soldering of the free front end of each connecting pin to an electrical terminal situated on the outside of the cover hood.

In a contactor according to the invention, in this preferred arrangement, the free end of each of these connecting pins is accessible in the rear face of the support, in particular with a view to carrying out a soldering operation.

It should be understood that in this Application, references to soldering or welding include alternative methods such as brazing, where appropriate in practice.

Preferably, each of these electrical connecting pins is at least partly surrounded by the insulating material of the body of the support.

According to the invention in a second aspect, a motor vehicle starter is equipped with a contactor according to the said first aspect of the invention.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
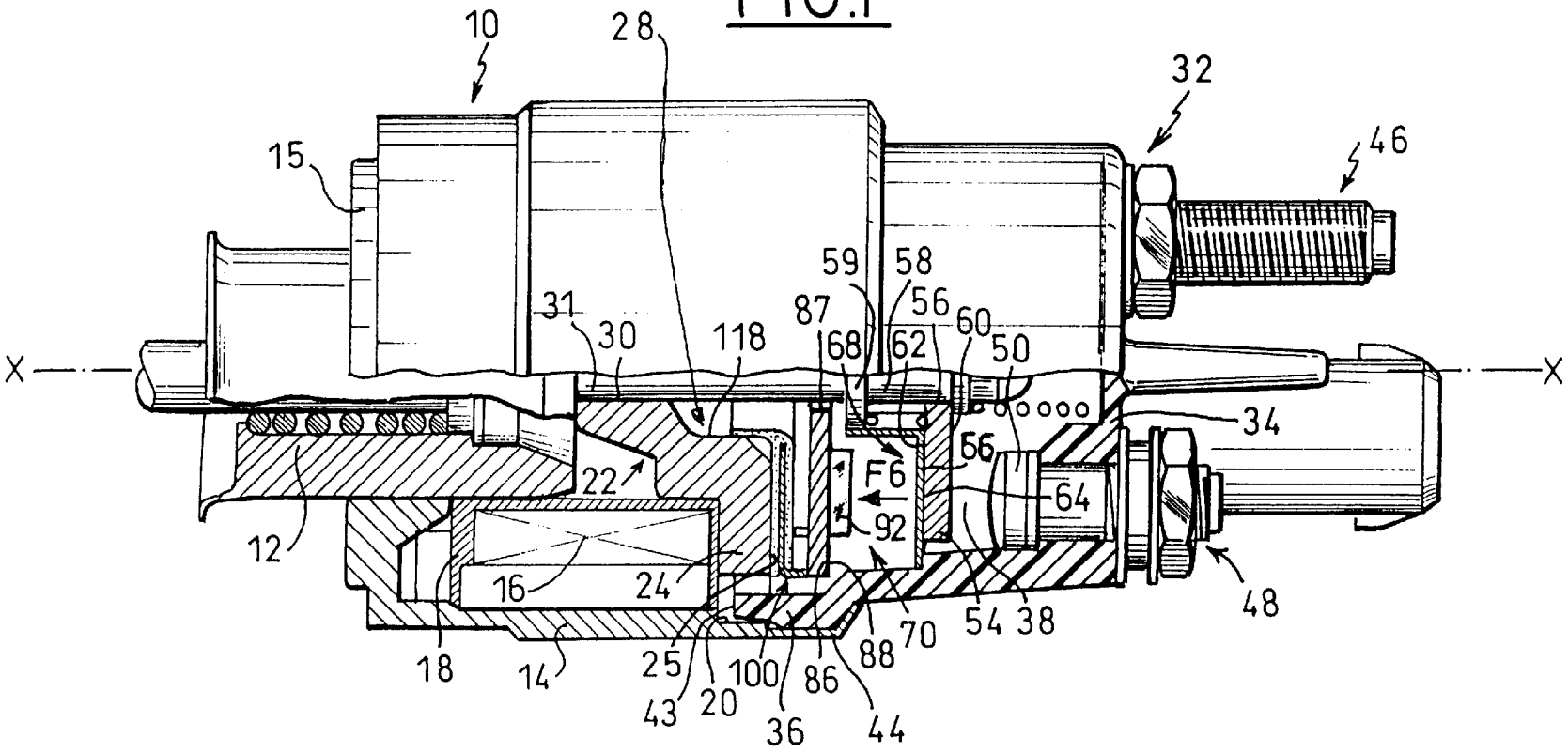
FIG. 1 is a view in partial axial cross section, of a starter contactor which includes an electronic control circuit mounted inside the contactor by means of a support in accordance with the invention.

FIG. 1 shows an electromagnetic contactor 10 which is arranged to equip a starter (not shown) for an internal combustion engine of a motor vehicle. The contactor 10 comprises a movable core 12 which is connected to one end of a pivoting lever (not shown), the other end of which is connected to the driving element of the starter head, the latter being of any suitable known type. The electromagnetic contactor 10 also includes an external armature 14, which is of generally annular cylindrical form with an axis X—X. Inside the armature 14 there is disposed, in particular, an annular contactor coil 16.

The movable core 12 is mounted for axial sliding movement within a tubular skirt 18 which is fixed on the central portion 20 of a fixed core 22 of generally disc-shaped form. The fixed core 22 includes a flat, annular main portion 24 which lies in a plane at right angles to the axis X—X and which is fixed within an internal housing 28 defined in the front part of the armature 14. The central portion 20 of the core 22 has a central hole 30 for guiding, in sliding movement along the axis X—X, a control rod 31 on which the movable core 12 is abutted axially so as to displace the control axially.

The contactor 10 also includes a cover hood 32, which is molded in a suitable insulating material, for example a thermoplastics material. The cover hood 32 is in the general form of a cylindrical pot centered on the axis X—X and comprising a radial terminal base portion 34 at right angles to the axis X—X, together with a cylindrical lateral skirt portion 36. The main part of the skirt portion 36 defines a cylindrical internal housing 38, and its annular free rear terminal edge 43 is in axial abutment against the transverse front face 25 (in facing relationship with it) of the disc-shaped portion 24 of the fixed core 22. The cover hood 32 is mounted sealingly on the armature 14 by a circumferential seam which is obtained by inward radial deformation of a thin axial terminal portion 44 of the armature 14.

In a manner known per se, the contactor 10 has two fixed terminals 46 and 48 of electrically conductive material, which are incorporated in the base portion 34 of the cover hood 32 during the molding of the latter. Each of these fixed terminals 46 and 48 has a contact head 50, and both of these heads 50 lie in a plane at right angles to the axis X—X, inside the housing 38.

Again in a manner known per se, the control rod 31 carries, at its free front end, a movable contact 54 in the form of a rectangular plate, which has a central hole 56 through which a portion 58 of the control rod 31 extends.

In the rest position shown in FIG. 1, the movable core 12, the control rod 31 and the movable contact 54 are biased elastically towards the left (with reference to FIG. 1) by means of a return spring (not shown), which is arranged between the movable core 12 and the radial rear end face 15 of the armature 14.

In the working position, that is to say when the contactor coil 16 is energize, the movable core 12 and the control rod 31 drive the movable contact 54 from left to right with reference to FIG. 1, thus making contact between its front face 60 and the contact heads 50 of the fixed terminals 46 and 48.

In the embodiment of the invention shown in the drawings, the movable contact 54 engages, in the rest position, through its rear face 62 against the front face 64 (in facing relationship with it) of a radially oriented transverse front wall 66 of a guide bush 68. The guide bush 68 guides a collar 59 of the control rod 31.

An electronic control circuit 70 for the contactor is arranged in an axial position lying intermediately between the front transverse face of the fixed core 22 and the movable contact 54. This electronic control circuit 70 consists essentially of a printed circuit board 86 in the general form of a disc, having a central hole 87 through which the control rod 31 passes. The circuit board 86 carries various electronic components 92 of the circuit, in particular on its front transverse face 88.

The electronic control circuit 70 is disposed and fixed within the contactor by means of a support 100.

Figure 2:
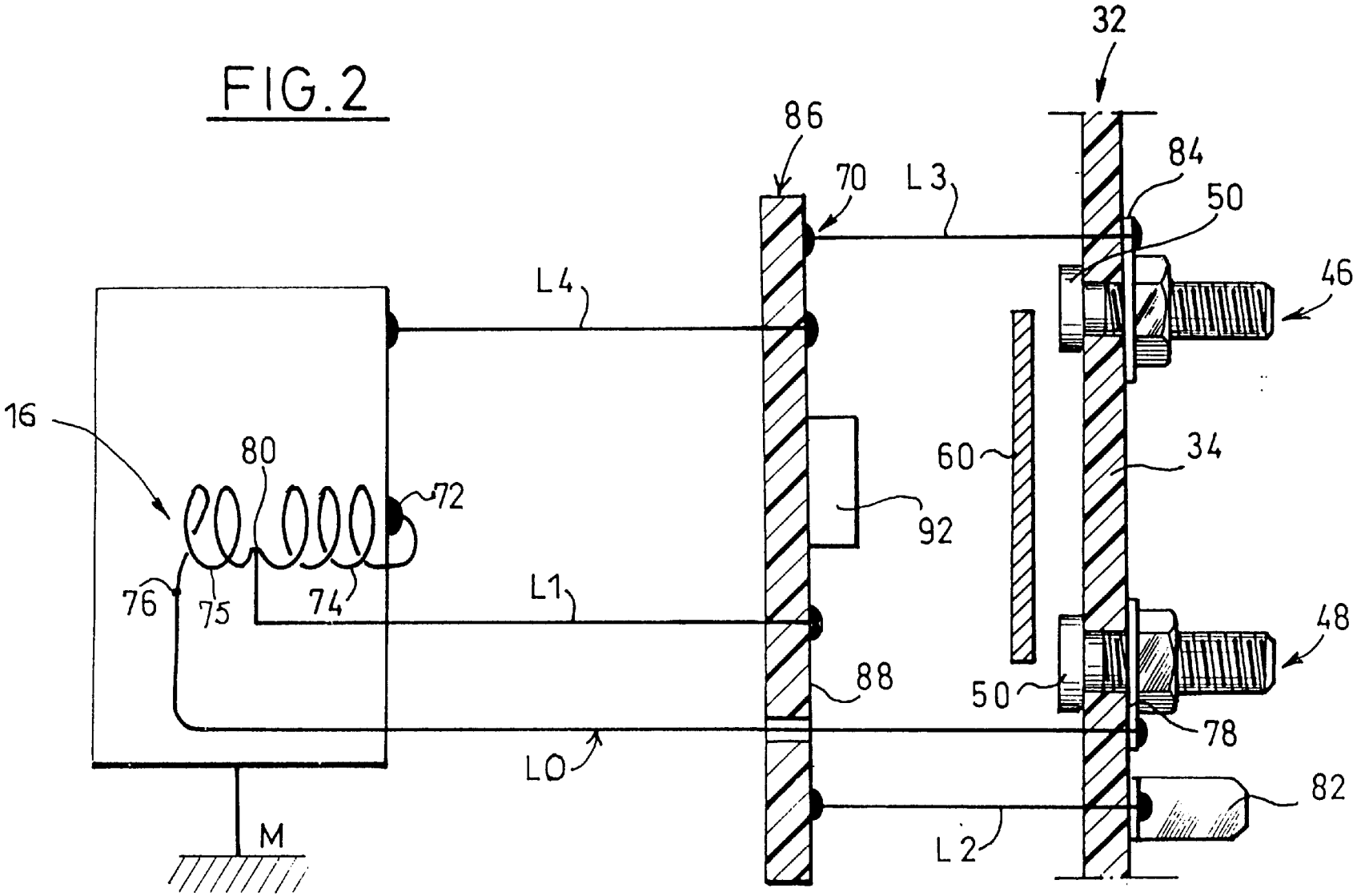
FIG. 2 is a diagrammatic view showing the various electrical connections between the electronic control circuit and the other components of the contactor.

FIG. 2 shows, diagrammatically, various components of the contactor 10 which are indicated by the same reference signs as in FIG. 1. The diagram of FIG. 2 shows in general terms the various electrical connections which it is necessary to provide between the contactor coil 16, the printed circuit board 86, and the cover hood 32.

With reference therefore to FIG. 2, the end 72 of the holding winding 74 of the contactor coil 16 is connected to ground (or earth) M of the magnetic casing of the contactor, of which the fixed core 22 is a part. The end 76 of the main, or actuating, winding 75 of the contactor coil 16 is connected electrically through an electric connection LO to a tongue 78 which is associated with the fixed terminal 48, carried by the cover hood 32 and situated outside the latter.

The common output end 80 of the main winding 75 and holding winding 74 is connected electrically through a further electrical connection L1 to a conductive strip which is part of the printed circuit on the printed circuit board 86, this conductive strip being formed on the front face 88 of the latter. The control terminal 82 of the contactor is mounted on the outside of the cover hood 32, and is connected electrically through a further connection L2 to a conductive strip of the printed circuit arranged on the front face 88 of the printed circuit board 86.

The positive power supply terminal 46 carried by the cover hood 32 feeds the electronic control circuit 70 through another electrical connection L3, which connects a tongue 84, on the outside of the cover hood 32 and connected electrically to the terminal 46, to a conductive strip on the front transverse face 88 of the printed circuit board 86. Finally, an electrical ground or earth connection L4 connects a conductive earthing strip, on the transverse face 88 of the printed circuit board 86, to ground M.

The support 100 will now be described in detail with reference in particular to FIGS. 3 to 5. The support 100 is a generally disc-shaped component which is interposed axially between the front transverse face 25 of the fixed core 22 and the electronic control circuit 70. In the embodiment shown in the drawings, the support 100, which has a central hole through which the control rod 31 extends, consists essentially of a body 102 of a suitable insulating material, in the general form of a disc which is formed by molding it around an insert 104 of conductive material.

The insert 104 is a member which is made from conductive sheet material by blanking, press-forming and bending, so as to give the appropriate configuration to the insert 104. This is then placed in a mold, in which the body 102 of insulating material is formed by molding it around the insert 104. The conductive member 104 provides the mechanical function of fastening the electronic control circuit 70 on the fixed core 22, and also provides the electrical connection between the ground side of the printed circuit and the earth (ground) represented by the core 22, that is to say the electrical connection L4 indicated diagrammatically in FIG. 2. The conductive insert 104 also provides the electrical connection from some conductive areas (connecting elements) of the printed circuit on the printed circuit board 86 to the terminals 46 and 82 carried by the cover hood, that is to say it also represents the electrical connections L2 and L3 indicated diagrammatically in FIG. 2.

For this purpose, the conductive insert 104 is in the general form of a triangular plate, the flat central portion 106 of which is extended radially outwardly by three fastening and connecting lugs 108, which are spaced apart circumferentially substantially by 120 degrees about the central axis X—X of the support 100. In this connection, the support 100 is designed to be mounted coaxially with the other components of the contactor 10 having the axis X—X. The central portion 106, in the form of a plate, has a central hole 107 through which the control rod 31 can pass, with part of the insulating body 102 interposed.

Each of the lugs 108 provides, firstly, fastening of the support 100 to the fixed core 22 of the contactor, with electrical connection of the lug 108 to ground on the fixed core 102, and secondly, fastening of the printed circuit board 86 to the support 100 itself. For this purpose, each lug 108 comprises a flat main portion 110 which extends radially outwardly in the same plane as the central portion 106. The central portion 110 of each lug 108 is formed with a boss 112 which projects axially towards the rear, i.e. towards the transverse rear face 25 of the fixed core 22 of the contactor 10.

There is no insulating material on any of the transverse lugs 108, and for this purpose the molded insulating body 102 is formed with an edgewise recess 114 facing each of the transverse lugs 108, on either side of the latter.

Figure 3:
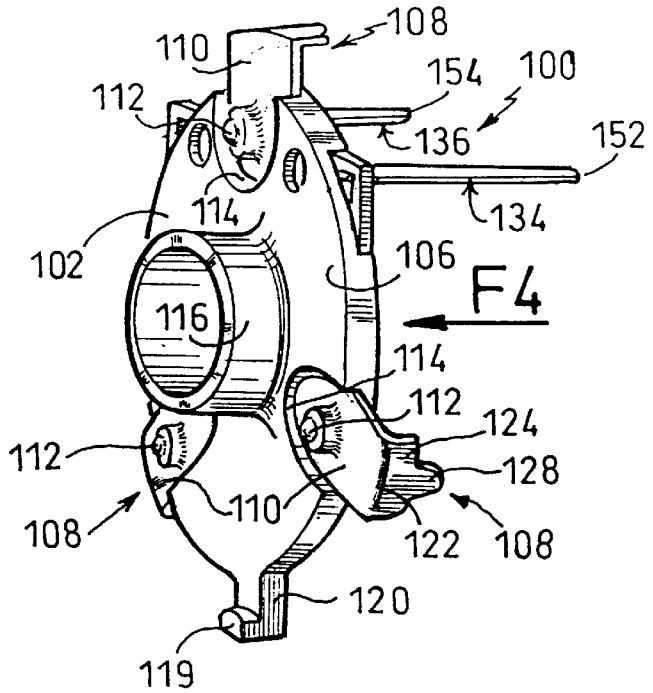
FIG. 3 is a perspective view of the support for the electronic circuit, in accordance with features of the invention.
Figure 4:
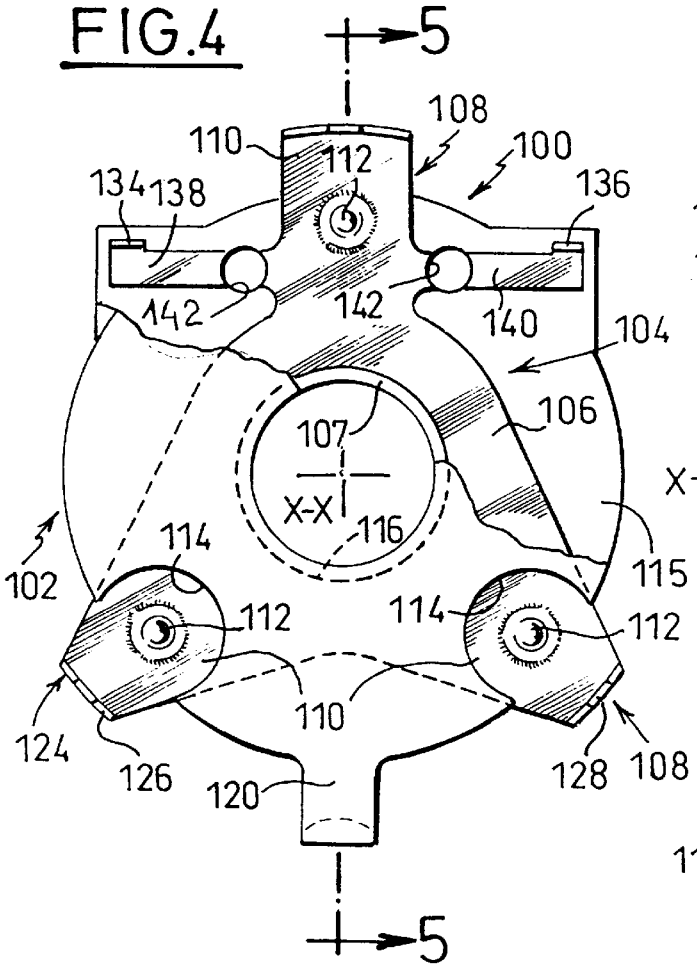
FIG. 4 is an end view in the direction of the arrow F4 in FIG. 3, again showing the support for the electronic circuit.
Figure 5:
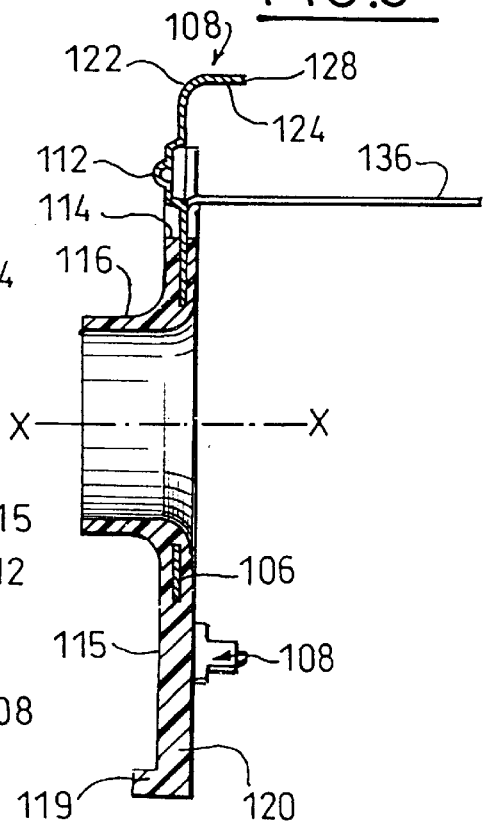
FIG. 5 is a view in cross section taken on the line 5—5 in FIG. 4.

As can be seen in FIGS. 3 and 5, each boss 112 projects axially towards the rear from the rear transverse face 115 of the disc-shaped insulating body 102, in such a way that each boss 112 constitutes a contact and fastening pad for the support 100 on the front transverse face 25 of the fixed core 22. For this purpose, the pads constituted by the bosses 112 is fixed to the fixed core 22, for example by welding. This fastening, which may for example be performed by an electrical resistance welding operation, ensures that the support 100 is mechanically secured and that the lugs 108 are connected electrically to ground via the fixed core 22.

Any other suitable method of fastening and electrical connection may of course be used, for example a riveting or screw fastening operation.

Centering and angular indexation of the support 100 with respect to the fixed core 22 are provided by means of the insulating body 102. To this end, the generally disc-shaped insulating body 102 has a cylindrical central axial spigot having a surface 116 which is arranged to be centered in the central hole 118 formed in the central portion 20 of the fixed core 22 (as to which, see FIG. 1).

For the purpose of angular indexation, the insulating body 102 includes an indexing finger 119 which is arranged at the end of a radial lug 120 formed integrally with the insulating body 102, and which is received in a complementary notch formed in the front transverse face 25 of the fixed core 22.

For mechanical fastening of the printed circuit board 86 and electrical earth connection of the printed circuit, each of the lugs 108 is extended beyond the radial terminal edge 122 of its main portion 110, by an axially oriented branch 124. This branch 124 is extends axially forward to terminate in a transverse front edge 126. A fastening and connecting tag 128 extends axially forward from the middle of the front transverse edge 126. Each of these tags 128 is arranged to be received in a notch or slot 130 (see FIG. 6), which is formed in the cylindrical peripheral edge 89 of the printed circuit board 86.

Figure 6:
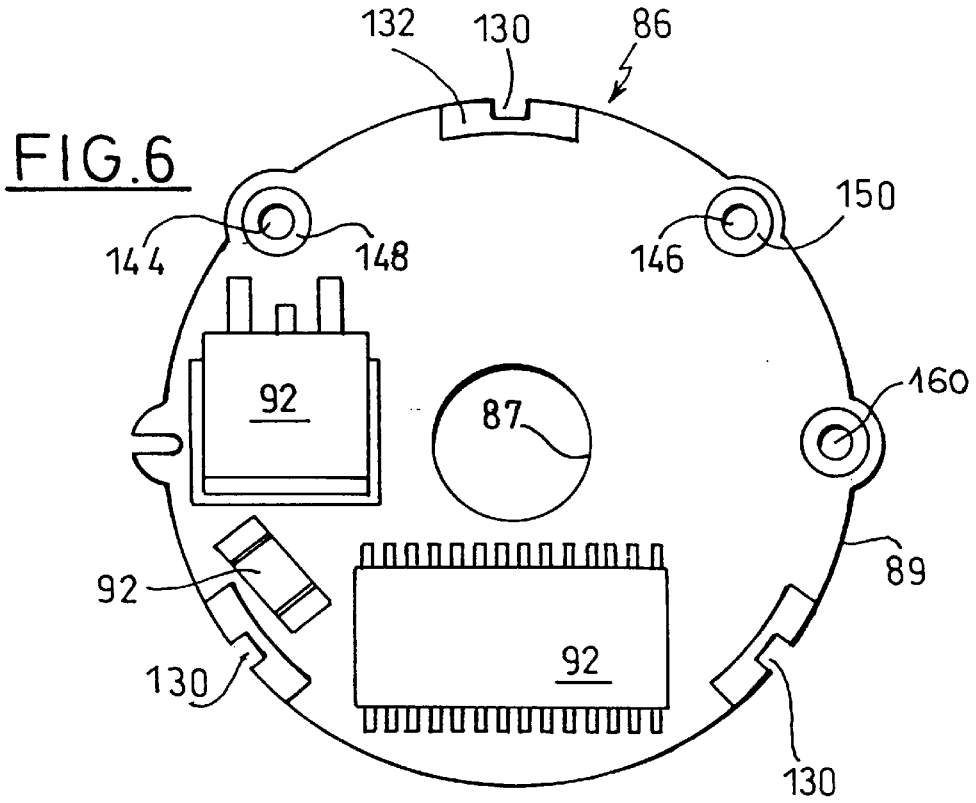
FIG. 6 is a view showing details of the electronic control circuit, as seen in the direction of the arrow F6 in FIG. 1.

As can be seen more particularly in FIG. 6, to which reference is now also made, each of the notches 130 is surrounded, on the front transverse face 88 of the printed circuit board 86, by a conductive element consisting of an earthing strip 132.

When the printed circuit board 86 is placed in position with respect to the support 100, that is to say when the three tags 128 are received in the notches 130, the tags 128 project axially beyond the front transverse face 88, and a soldering operation can then be carried out to secure the tags 128 on the strips 132. This soldered connection secures the printed circuit board 86 mechanically to the support 100. In this connection, the axial position of the printed circuit board 86 with respect to the support 100 is determined by the rear transverse face of the support coming into abutment against the transverse terminal edges 126 of the axial branches 124 of the lugs 108. At the same time, the soldered connection provides the electrical connection of the lugs 108 with the electrical earthing strips 132 of the printed circuit board 86.

The electrical connections between the printed circuit board 86 and the terminals 82 and 46 of the cover hood 32 are made by means of electrical connecting pins 134 and 136 which are incorporated in the support 100, and which will now be described. The two pins 134 and 136 are of similar design to each other, and are disposed symmetrically about the vertical median general plane of symmetry of the support 100, corresponding to the section line 5—5 in FIG. 4. The pins 134 and 136 are initially formed integrally with the conductive insert 104. Accordingly the insert 104 includes two transverse branches 138 and 140 which extend, initially from the junction zone between the upper lug 108 (with reference to FIGS. 3 to 5) and the central portion 106, and in opposite directions to each other. Each of these transverse branches 138 and 140 then extends axially forward, being bent back at 90 degrees for this purpose, so as to constitute an axially oriented branch 134, 136 respectively.

After the insulating body 102 has been molded into place, the transverse branches 138 and 140 are separated, and therefore insulated electrically, by a punching operation which consists in forming two through holes 142. The connecting pins 134 and 136 are therefore now insulated electrically from each other, and they are also insulated from the earthing lug 108.

Each connecting pin 134 or 136 is in the form of a flat pin which is arranged to extend through a hole 144, 146 respectively formed in the printed circuit board 86. As shown in FIG. 6, each of these holes 144, 146 is surrounded by a conductive element 148, 150 respectively formed on the front transverse face 88 of the printed circuit board 86. It is therefore possible to perform a soldering operation to secure the central portion of the elongated body of each of the connecting pins 134, 136 with the corresponding conductive element 148, 150, so as to connect the pins 134 and 136 electrically with the conductive elements of the printed circuit carried by the printed circuit board 86.

It will be noted that soldering of the central portions of the bodies of the pins 134 and 136 to the conductive elements 148 and 150 of the printed circuit completes the mechanical fastening of the printed circuit board 86 on the support 100.

Figure 7:
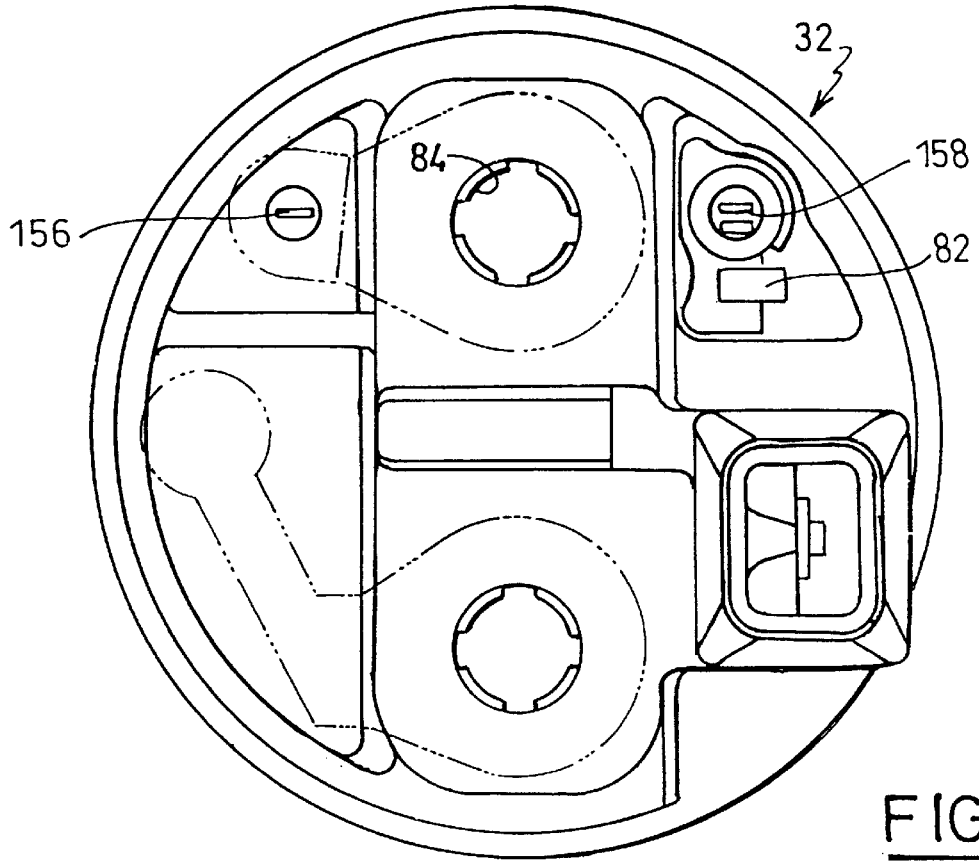
FIG. 7 is a view on the outer transverse face of the cover hood of the contactor, the cover hood being shown without its various connection terminals.

With the printed circuit board 86 mounted on the support 100, the pins 134 and 136 extend axially beyond the front transverse face 88, towards the cover hood, so that their free ends 152 and 154 pass through holes, in the form of slots 156 and 158 respectively (see FIG. 7), which are formed in the cover hood 32. On the outside of the cover hood 32, these slots 156 and 158 are surrounded by further conductive elements, which are part of connecting tongues that are connected to the positive power terminal 46 and the control terminal 82, such as the tongue 84 (FIGS. 2 and 7).

The electrical connections L2 and L3 indicated diagrammatically in FIG. 2 are thus made, after the cover hood has been fitted, by soldering the free ends 152 and 154 of the connecting pins 134 and 136 to the corresponding conductive elements carried by the cover hood.

It is of course possible, without departing from the scope of the present invention, to provide other connecting pins extending from the support 100.

In accordance with a design known per se, the electrical connection LO from the common output end of the actuating winding and the holding winding of the contactor coil may be made directly by means of a conductive wire (not shown), which then passes through a hole 160 (FIG. 6) in the printed circuit board 86.

The application of the insulating body 102 by molding it in place, as described above, is of particular advantage because of its simplicity and low cost.

Without departing from the scope of the invention, it is also possible to make the support 100 in the form of two half-shells of insulating material, assembled together, for example by resilient mating engagement, with the half-shells enclosing conductive fastening lugs, the electrical connecting pins being in the form of tongues.

The design of the support 100 in accordance with the invention is also of particular advantage in that it is smaller in both the axial and radial dimensions, in the case of an insert encapsulated within an insulating body which is molded on to the insert: a single metal component, formed to shape by bending, enables the electrical connections between the printed circuit, ground (earth) and the terminals carried by the cover hood, all to be made.

Mechanical fastening of the printed circuit by means of the support 100 also gives the electronic circuit a very high resistance to vibrations.

What is claimed is:

1. A motor vehicle starter contactor comprising:

an armature;

a cover hood (a) a base portion, (b) a lateral skirt portion extending from the base portion and engaging the armature, so that the cover hood and armature define an internal housing, and (c) a plurality of fixed contact terminals on the base portion of the cover hood adapted to connect to a power supply circuit;

a disc-shaped fixed core mounted within the armature having a central hole;

a control rod, defining an axial direction, axially, rotatably mounted in the central hole of the fixed core;

a movable core mounted in the armature adapted to rotate axially in cooperation with the control rod, whereby to displace the control rod axially;

a contactor coil within the armature configured to actuate the movable core;

a movable contact coupled with the control rod and adapted to come into and out of engagement with said fixed contact terminals by movement of the control rod;

a disc-shaped printed circuit board having a central hole, interposed axially intermediate between the fixed core and the movable contact, with the control rod extending through the central hole of the printed circuit board;

an electronic control circuit carried by the printed circuit board having a component; and a support affixed to the fixed core and to the printed circuit board, the support adapted to provide an electrical connection to ground for the electronic control circuit and the fixed core.

2. A contactor according to claim 1, wherein the support comprises a generally plate-shaped conductive element having a central hole and interposed axially between a front face of the fixed core and a rear face of the printed circuit board.

3. A contactor according to claim 2, wherein the conductive element of the support further comprises a plurality of lugs extending radially from the conductive element in a plane substantially traverses to the axial direction, each said lug comprising:

a contact pad extending said lug axially rearwardly into contact with the front face of the fixed core and adapted to provide electrical contact and mechanical fastening of the support; and a branch extending said lug axially forwardly and adapted to provide an electrical ground connection and mechanical fastening for the printed circuit board.

4. A contactor according to claim 3, wherein each said contact pad comprises a boss formed in the corresponding said lug, and fixed to the front face of the fixed core.

5. A contactor according to claim 3, wherein the printed circuit board further comprises (a) a plurality of conductive ground connection elements on a front face of the printed circuit board, and (b) a plurality of through holes adjacent to said ground connection elements;

wherein each said branch of said lugs comprises (a) a transverse front terminal edge defining an axial engagement surface which is in engagement with a portion of the rear face of the printed circuit board in facing relationship with the engagement surface, (b) a terminal tag extending the said branch from said front terminal edge, each said terminal tag being received in a said through hole of the printed circuit board and projecting beyond the front face of the printed circuit board, each said terminal tag being soldered to a said ground connection element associated with the corresponding said through hole.

6. A contactor according to claim 5, wherein each said through hole of the printed circuit board receives a corresponding said terminal tag in a notch formed in the periphery of the printed circuit board.

7. A contactor according to claim 3, wherein the support has three said lugs angularly offset at intervals substantially equal to 120 degrees.

8. A contactor according to claim 2, wherein the support further comprises a body of insulating material, at least partially surrounding the conductive element of the support, and adapted to position the support with respect to the fixed core.

9. A contactor according to claim 8, wherein the insulating body of the support is a layer of insulating material applied by molding around the conductive element.

10. A contactor according to claim 8, wherein the insulating body of the support comprises:

a cylindrical centering surface extending axially and rearwardly, and adapted to be received in the central hole of the fixed core;

an angular indexing finger adapted to indicate the angular position of the support with respect to the fixed core.

11. A contactor according to claim 1, wherein the printed circuit board has a front face and at least one conductive electrical connection element on the front face, the printed circuit board defining a through hole adjacent to said electrical connection element, wherein the support further comprises at least one electrical connecting pin of conductive material having a body extending axially forwardly through a corresponding said through hole in the printed circuit board and being connected electrically by soldering to the adjacent said electrical connection element, wherein the body of said electrical connecting pin further comprises a portion extending said electrical connecting pin axially beyond the front face of the printed circuit board and through the base portion of the cover hood, said electrical connecting pin having a free front end thereby projecting on the outside of the cover hood and being connected electrically by soldering to a corresponding said fixed contact terminal carried by the cover hood.

12. A contactor according to claim 8, wherein the printed circuit board has a front face and at least one conductive electrical connection element on the front face, the printed circuit board defining a through hole adjacent to said electrical connection element, wherein the support further comprises at least one electrical connecting pin of conductive material having a body extending axially forward through a corresponding said through hole in the printed circuit board and being connected electrically by soldering to the adjacent said electrical connection element, wherein the body of said electrical connecting pin further comprises a portion extending said electrical connecting pin axially beyond the front face of the printed circuit board and through the base portion of the cover hood, said electrical connecting pin having a free front end thereby projecting on the outside of the cover hood and being connected electrically by soldering to a corresponding said fixed contact terminal carried by the cover hood, and wherein the body of insulating material of the support at least partially surrounds said electrical connecting pin.

13. A motor vehicle starter comprising a contactor having:

an armature;

a cover hood (a) a base portion, (b) a lateral skirt portion extending from the base portion and engaging the armature, so that the cover hood and armature define an internal housing, and (c) a plurality of fixed contact terminals on the base portion of the cover hood adapted to connect to a power supply circuit;

a disc-shaped fixed core mounted within the armature having a central hole;

a control rod, defining an axial direction, axially, rotatable mounted in the central hole of the fixed core;

a movable core mounted in the armature adapted to rotate axially in cooperation with the control rod, whereby to displace the control rod axially;

a contactor coil within the armature configured to actuate the movable core;

a movable contact coupled with the control rod and adapted to come into and out of engagement with said fixed contact terminals by movement of the control rod;

a disc-shaped printed circuit board having a central hole, interposed axially intermediate between the fixed core and the movable contact, with the control rod extending through the central hole of the printed circuit board;

an electronic control circuit carried by the printed circuit board having a component; and a support affixed to the fixed core and to the printed circuit board, the support adapted to provide an electrical connection to ground for the electronic control circuit and the fixed core.

* * * * *